United States Patent [19]

Ray et al.

[11] Patent Number: 4,739,371

[45] Date of Patent: Apr. 19, 1988

[54] LOW COST BELT MODULE

[75] Inventors: C. Michael Ray, Fairport; Frank Y. Yang, Penfield; Dennis M. Ankrom, Williamson, all of N.Y.

[73] Assignee: Xerox Corporation, Stamford, Conn.

[21] Appl. No.: 929,296

[22] Filed: Nov. 10, 1986

[51] Int. Cl.[4] ..... G03G 15/00

[52] U.S. Cl. ..... 355/16

[58] Field of Search ..... 355/3 BE, 16; 198/813

[56] References Cited

U.S. PATENT DOCUMENTS

| | | | |
|---|---|---|---|
| 3,456,776 | 7/1969 | Viene | 198/208 |
| 3,646,866 | 3/1972 | Baltazz et al. | 355/15 |
| 3,695,346 | 10/1972 | Nichols | 165/120 |
| 4,013,358 | 3/1977 | Kawai | 355/16 X |
| 4,062,631 | 12/1977 | Ichikawa et al. | 355/16 X |
| 4,279,496 | 7/1981 | Silverberg | 355/16 X |
| 4,319,829 | 3/1982 | Janeway, III et al. | 355/3 BE |
| 4,416,532 | 11/1983 | Rosati | 355/3 BE |
| 4,470,690 | 9/1984 | Hoffman | 355/16 X |
| 4,563,077 | 1/1986 | Komada | 355/3 BE |
| 4,616,920 | 10/1986 | Itoigawa et al. | 355/3 BE |

FOREIGN PATENT DOCUMENTS

| | | | |
|---|---|---|---|
| 6103185 | 1/1986 | Japan | 355/16 |

*Primary Examiner*—Patrick R. Salce
*Assistant Examiner*—Marc S. Hoff
*Attorney, Agent, or Firm*—Ronald F. Chapuran

[57] ABSTRACT

A removable belt module for use in a reproduction machine for replacing photoreceptor belts including a pair of support rolls for supporting the photoreceptor belt and a pivot element disposed intermediate the support rolls and connected thereto by connecting arms, the arms being disposed in relative horizontal position for exerting tension on the belt for operation of the belt and being disposed in a relatively perpendicular relationship for relaxing the tension and replacing the belt. The belt module further includes shafts for engaging slots in the machine to mount the belt module and further includes a drive sprocket connected to one of the shafts for driving the photoreceptor belt.

11 Claims, 4 Drawing Sheets

LOW COST BELT MODULE

BACKGROUND OF THE INVENTION

The present invention relates to image recording apparatus, and in particular to a removable photoreceptor belt module.

The life of an image recording apparatus or reproduction machine is extended by replacement of worn or used photoreceptor belts. Replacement of a photoreceptor belt by a service representative can often be a complex and intricate operation. Such an operation can not only be time consuming and expensive, but if not accomplished with a great deal of care can damage the new photoreceptor belt.

The prior art is replete with examples or belt access and manipulation. For example, it is known in the food processing art, as disclosed in U.S. Pat. No. 3,456,776, that a food conveying belt can be pivoted about a belt frame to provide access to the underside of the belt for cleaning. U.S. Pat. No. 3,695,346 discloses a food processing table and conveyor belt wherein arms supporting the belt can be pivoted to open the table for cleaning and then pivoted back to a belt tightened position. It is also known in the xerographic art, as disclosed in U.S. Pat. No. 3,646,866, to use a lever to position a tensioning roll engaging a photoconductive belt in a reproduction machine. In addition, U.S. Pat. No. 4,563,077 discloses a photoconductive belt that is tensioned by a roll. The photoreceptor belt can be removed when the tension roll is retracted by operation of a crank.

U.S. Pat. No. 4,319,829 teaches a photoconductor belt removal system including a belt supporting capstan which is cantilever attached to the main machine frame and which includes a pivotable handle for releasing or engaging a shoe against the inner surface of the belt for applying or releasing tension to that belt. U.S. Pat. No. 4,416,532 discloses a cantilever mounted photoconductor belt capstan that is rigidly secured to the machine frame by a pivotable mechanism including a slide pin and dog arrangement for cooperating with a receiving block on the machine frame. The same mechanism is arranged to operate a tension applying releasing shoe against an inner surface of the photoconductor belt and pivoting of the mechanism to the open position results in an open access to the capstan in order that a closed loop photoconductor belt is removed or installed on the capstan.

These prior art devices either do not effect replacement or removal of belts or require relatively complex procedures for replacement or removal of belts, particularly with the belt supporting mechanism often not totally removable from the machine. There is a need for a relatively simple procedure to completely remove a belt module from the frame of a machine, and then to be able to easily replace the photoreceptor belt on the belt module. Accordingly, it is an object of the present invention to provide a new and improved removable belt module and new and improved method for replacing a photoreceptor belt on the belt module. Another object of the present invention is to provide a simple pin and groove system for mounting and removing a belt module from the machine frame, and it is another object of the present invention to provide a belt module having a pivot and spring mechanism to properly tension a belt for machine operation and for pivoting the arms of the belt arrangement upon removal from the machine for easy replacement of a photoreceptor belt. Further advantages of the present invention will become apparent as the following description proceeds and the features characterizing the invention will be pointed out with particularity in the claims annexed to and forming a part of this specification.

Briefly, the present invention is a removable belt module for use in a reproduction machine for replacing photoreceptor belts including a pair of support rolls for supporting the photoreceptor belt and a pivot element disposed intermediate the support rolls and connected thereto by connecting arms, the arms being disposed in relative horizontal position for exerting tension on the belt for operation of the belt and being disposed in a relatively perpendicular relationship for relaxing the tension and replacing the belt. The belt module further includes shafts for engaging slots in the machine to mount the belt module and further includes a drive sprocket connected to one of the shafts for driving the photoreceptor belt.

For a better understanding of the present invention reference may be had to the enclosed drawings wherein reference numerals have been applied to like parts wherein.

Figure 1:
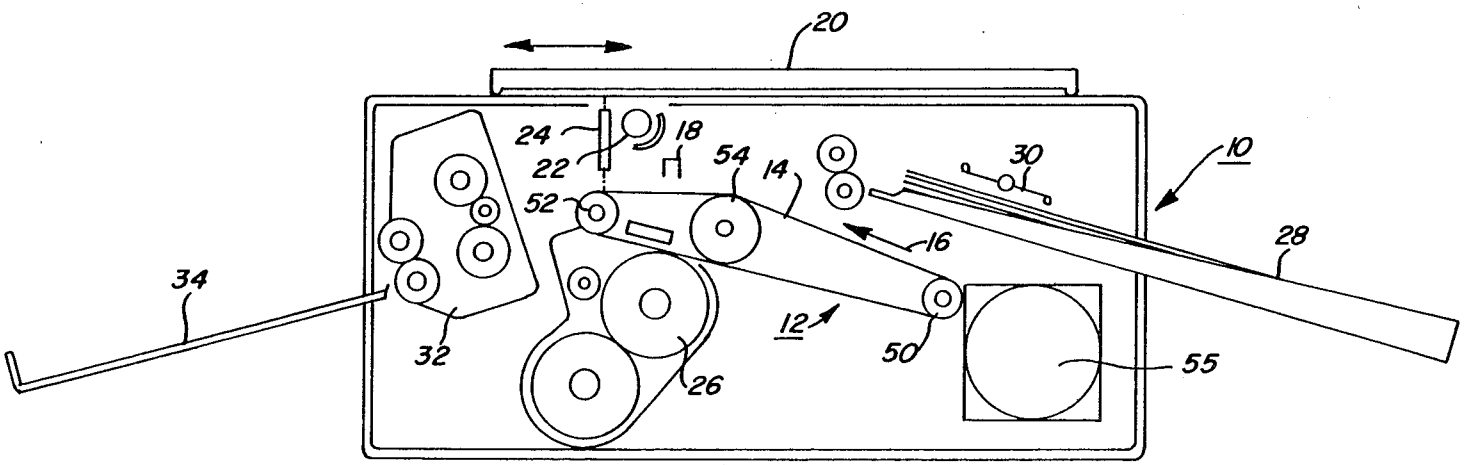
FIG. 1 is an elevational view of an exemplary reproduction machine incorporating the present invention.

With reference to FIG. 1, there is illustrated an electrophotographic printing or reproduction machine generally indicated at 10 including a belt module generally indicated at 12 having a photoconductive surface 14 moving in the direction of the arrow 16 to advance successive portions of the photoconductive surface through various processing stations, starting with a charge/transfer station having a charge/transfer pin corotron 18 for first charging the photoconductive surface 16 to a relatively high substantially uniform potential.

The charged portion of the photoconductive surface 14 is then advanced through an imaging station where an original document is positioned face down on the moving platen 20 projecting an image of the document illuminated by the tungsten lamp 22 through Selfoc lens 24 onto the charged portion of the photoconductive surface 14. The photoconductive surface 14 then advances to mag brush developer 26 for applying a developer material into contact with the electrostatic latent image. The latent image attracts toner particles from the carrier granules of the developer material to form a toner powder image on the photoconductive surface 14.

The toner powder image then advances to the charge/transfer station and corotron 18 wherein a copy sheet from the copy feed tray 28 provides the paddle wheel feeder 30 with a copy sheet to move it into contact with the toner powder image. After transfer, the copy sheet is advanced to cold pressure fuser 32 for permanently affixing the transferred powder image to the copy sheet. After fusing, the copy sheet is transported to a copy output tray 34. In a preferred embodiment, transfer occurs at the top of the belt module 12 using the charge transfer corotron 18 during the second cycle of a two-cycle process. Paper stripping is accomplished by a 1" diameter strip roll 52 of the belt module 12. The belt module acts as a conveyor belt in transporting the lead edge of a copy sheet into the fuser 32, eliminating a separate belt transport subsystem. The inverted paper path results in the output copy face down in the tray 34.

Figure 2:
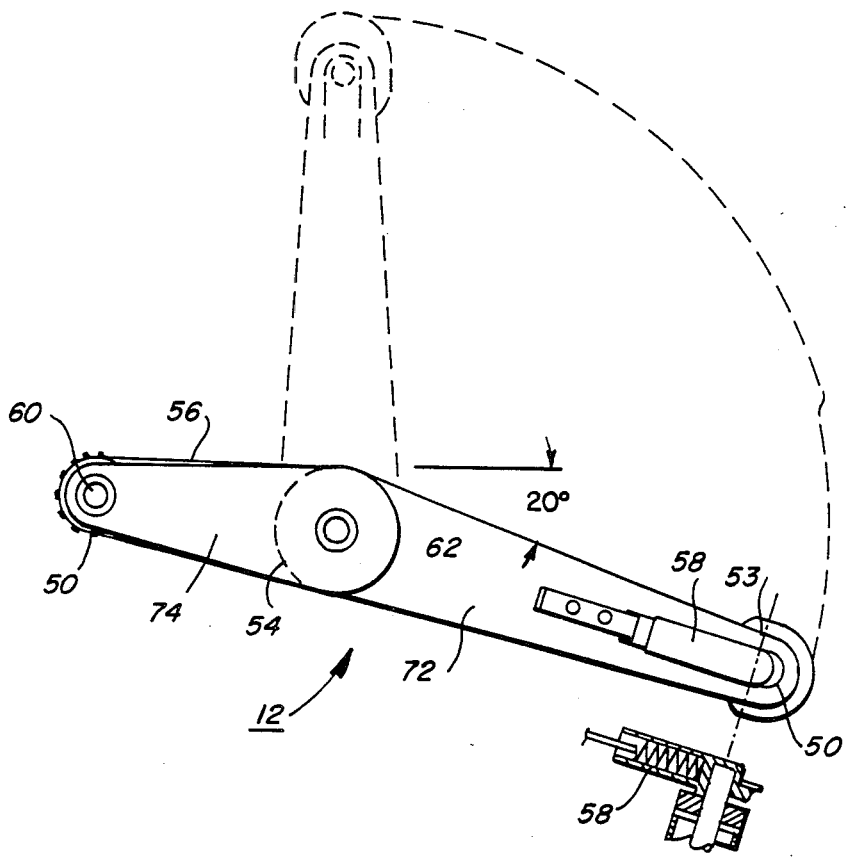
FIG. 2 is an enlarged end view of the belt module illustrated in FIG. 1 in accordance with the present invention.
Figure 3:
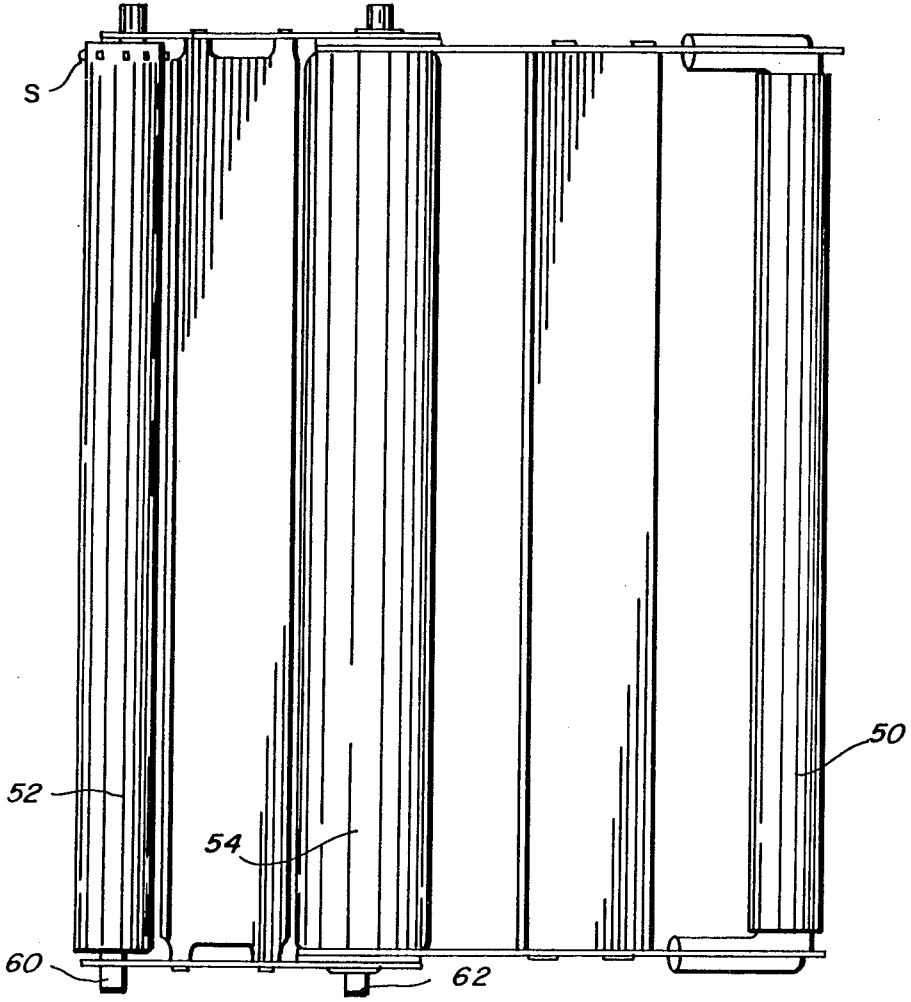
FIG. 3 is a top view of the belt module of FIG. 1.

With respect to FIGS. 2 and 3, there is illustrated the end and top views of a belt module 12 in accordance with the present invention, including a drive roll 50, the stripper roll 52, and an idler roll 54, supporting a belt 56 carrying the photoconductive surface 14, the belt is preferably of Mylar with a thickness of approximately 0.076 millimeters and a modulus of elasticity of 3500 newton per square millimeter and a belt width of approximately 300 millimeters. The drive roll 50 is mounted against a spring 58 for the purpose of imparting tension to the belt 56. Preferably, the tension on the belt is less than 4 pounds to reduce edge forces and enable the use of smooth rolls rather than more complex, low lateral force rolls. The drive belt 50 is driven by a sprocket 55 connected to a main drive 55, illustrated in FIG. 1. The drive and stripping rolls 50 and 52 are approximately 25 millimeters in diameter and spaced approximately 237 millimeters between centers. In a preferred embodiment, the idler roll 54 is approximately 44 millimeters in diameter and the idle roll 54 forms an angle of wrap of approximately 20° with the belt 56.

Figure 4:
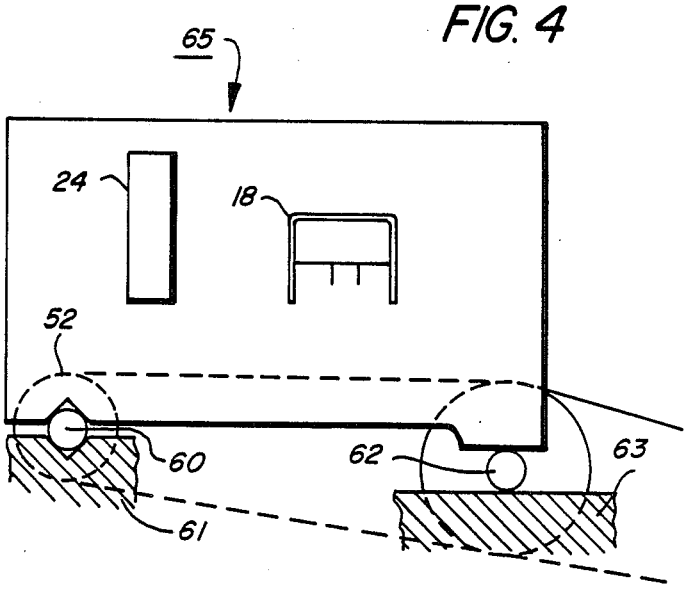
FIG. 4 illustrates the mounting of the belt module in the machine frame.

Preferably, the stripper and idler rolls 52, 54 turn on shafts 60 and 62, respectively. The ends of the shafts 60, 62 are seated into blocks 61, 63 molded into the frame of the machine to locate the module in the machine frame as shown in FIG. 4. The stripping roll shaft 60 rests in V-block 61 in order to provide both vertical and horizontal registration. The idler roll shaft 62 rests on a flat surface of block 63 to provide vertical registration but also to allow for variations in the shaft-to-shaft spacing. As shown in FIG. 4, preferably, an optics module 65, including the lens 24 and corotron 18 is mounted in a similar manner to the upper surface of the shafts. A not shown single latching mechanism provided on the optics module holds both assemblies in place. This mounting technique provides the best possible spacing control at each of the photoreceptors interfaces, i.e. charge/-transfer corotron, optic lens, developer roll, and paper entry. It also provides interchangeability of the optics and photoreceptor modules among different machines without individual set of adjustments. It should be noted that the stripper roll 52 could also be the drive roll with sprockets S as illustrated in FIG. 3.

Figure 5:
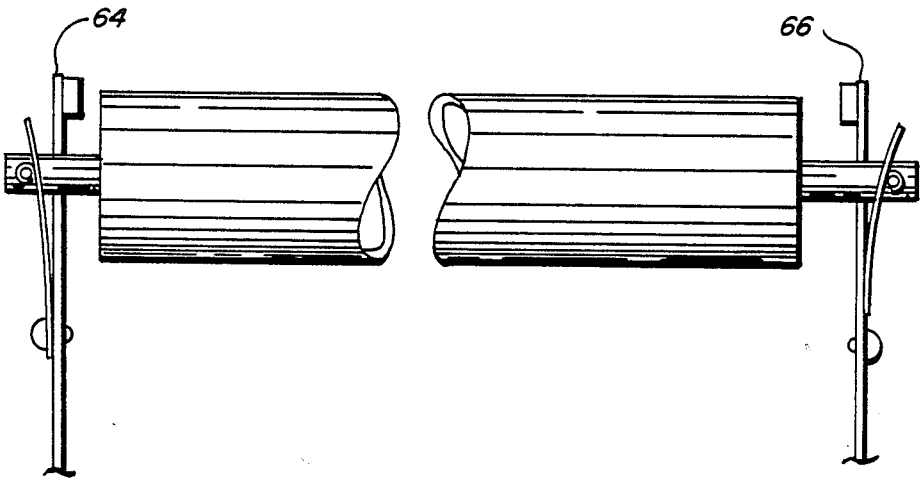
FIG. 5 is a cross sectional view of the drive roll of FIGS. 1, 2 and 3 illustrating the edge guides.

With reference to FIG. 5, photoreceptor belt tracking is accomplished by using edge guides 64 and 66 to arrest the sliding of the photoreceptor belt on the rolls. Belt tracking is described as the walking of the photoreceptor belt along the length of the rollers. Preferably, the edge force at the guides is at a low level, approximately less than 4 pounds, in order to prevent the collapse or folding of the photoreceptor edges. Preferably, the rolls are a smooth surface providing a low frictional force at the roll-to-Mylar interface. This allows slippage to occur thus negating excessive edge forces. Because of the slippage due to the low frictional force to limit the excessive edge forces and damage to the photoreceptor, the sprocket drive system is used. In a preferred embodiment, the photoreceptor has 112 holes along one edge. The holes are approximately 2×5 millimeters with rounded corners to minimize stress.

In accordance with the present invention, the belt module 12 is adapted for easy installation and removal from the machine and is also adapted for easy change of the photoreceptor belt 56, preferably, all drive and electrical connections disengage automatically. With reference to FIGS. 1 and 2, to replace the belt, it is merely necessary to slide or lift out the belt module 12, although depending upon the machine configuration it may be necessary to first remove other machine components. The module is slid out from the machine frame in the elongated shape as illustrated in FIG. 2 in solid lines. An elongated arm 72, interconnecting pivot shaft 62 with the drive shaft of drive roll 50, is then pivoted about the pivot shaft 62 to the bent or angular configuration as illustrated by the dotted lines. A second arm 74 interconnects shafts 60 and 62. The tension on the tension spring 58 is released and the photoreceptor belt 56 in this position is easily slid off the three rollers 52, 54 and 50. Preferably, the belt is detensioned by merely bending the module into the bent or vertical triangular position and the bent position with the smooth rolls facilitates belt replacement. A new belt is merely slipped over the three rolls. With the module in the triangular position, it is easier to slip on the photoreceptor, which generally takes the natural form of a cylinder. Upon replacement of the photoreceptor belt, the arm 72 is bent back to the near horizontal position, placing the tension of the spring 58 onto the belt 56 at the roll 50. This provides the sufficient amount of belt tension for the belt to suitably ride on the rollers when driven by the roll 50. In the horizontal position, the belt module is then loaded back into the machine.

It should be notd that the combination spur gear/-sprocket drive assembly giving the photoreceptor drive motion makes possible for the automatic drive disengagement when the module is removed from the frame for belt replacement. It should also be noted the xerographic elements requiring spacing from the photoreceptor surface are directly referenced to the shafts of the module rolls, facilitating alignment rather than referenced to the frame of the machine. The narrow belt width and short length allows for a low belt tension which enables belt tracking with the side guides 64, 66 without the use of low lateral force rolls.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. A reproduction machine including a frame having a support slot and a removable belt module for replacing photoreceptor belts, the belt module comprising:

a photoreceptor belt, a first and a second support roll for supporting the photoreceptor belt, at least one of the support rolls mechanically engaging the support slot to secure the module to the frame, a pivotal roll disposed intermediate the first and second support rolls, a first arm interconnecting the first support roll to the pivot roll, a second arm interconnecting the second support roll and the pivot roll, the said first and second arms being disposed in a relative horizontal relationship for exerting tension on the belt and being disposed in a relative perpendicular relationship upon removal from the machine for relaxing the tension on the belt.

2. The module of claim 1 including a shaft journaled in one of said first and second support rolls, said shaft being a drive shaft, and a drive sprocket coupled to said drive shaft, said sprocket engaging sprocket holes in said photoreceptor belt.

3. A removable belt module for use in a reproduction machine comprising:

a photoreceptor belt, a first and a second support roll for supporting the photoreceptor belt, a pivot element disposed intermediate the first and second support rolls, a first arm interconnecting the first support roll to the pivot element, a second arm interconnecting the second support roll to the pivot element, said first and second arms being disposed in a relative horizontal relationship for exerting tension on the belt and being disposed in a relative perpendicular relationship for relaxing the tension on the belt.

4. The module of claim 3, wherein the pivot element is a shaft supporting an idler roll.

5. The module of claim 4, wherein the machine includes a frame having support slots and the first support roll is supported on a first shaft, each of the first shaft and the idler shaft engaging one of said support slots to secure the module to the frame.

6. The module of claim 3 including a drive shaft journaled in one of the support rolls.

7. The module of claim 6, wherein said drive shaft includes a drive sprocket.

8. The module of claim 3 including a spring, said spring mechanically engaging one of said rolls to exert tension on said belt with said arms in said relatively horizontal relationship.

9. A belt module in a reproduction machine comprising:

a photoreceptor belt, a first and a second support roll for supporting the photoreceptor belt, a pivot element disposed intermediate the first and second support rolls, a first arm interconnecting the first support roll to the pivot element, a second arm interconnecting the second support roll and the pivot element, said first and second arms being disposed in a relative horizontal relationship for exerting tension on the belt and being disposed in a relative perpendicular relationship for relaxing the tension on the belt.

10. The module of claim 9, wherein the pivot element is an idler shaft supporting an idler roll.

11. A removable belt module for use in a reproduction machine comprising:

a photoreceptor belt, a first and a second support roll for supporting the photoreceptor belt, a pivot element disposed intermediate the first and second support rolls, a first arm interconnecting the first support roll tot he pivot element, a second arm interconnecting the second support roll to the pivot element, said first and second arms being disposed in a relative horizontal relationship for operation within the machine and upon removal from the machine being disposed in a relative perpendicular relationship for replacing the photoreceptor.

* * * * *